US010657862B2

(12) United States Patent
Zhang

(10) Patent No.: US 10,657,862 B2
(45) Date of Patent: May 19, 2020

(54) DRIVING METHOD FOR DISPLAY DEVICE, TIMING CONTROLLER AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventor: Yanping Zhang, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 28 days.

(21) Appl. No.: 15/752,400

(22) PCT Filed: Jul. 14, 2017

(86) PCT No.: PCT/CN2017/092966
§ 371 (c)(1),
(2) Date: Feb. 13, 2018

(87) PCT Pub. No.: WO2018/059081
PCT Pub. Date: Apr. 5, 2018

(65) Prior Publication Data

US 2019/0005862 A1 Jan. 3, 2019

(30) Foreign Application Priority Data

Sep. 29, 2016 (CN) ..... 2016 1 0867454

(51) Int. Cl.
*G09G 3/20* (2006.01)

(52) U.S. Cl.
CPC ..... *G09G 3/20* (2013.01); *G09G 2310/0264* (2013.01); *G09G 2310/061* (2013.01);
(Continued)

(58) Field of Classification Search
CPC ..... G09G 3/20
(Continued)

(56) References Cited

U.S. PATENT DOCUMENTS

2006/0092115 A1* 5/2006 Matono ..... G09G 3/22 345/90
2006/0187352 A1* 8/2006 Kuo ..... H04N 7/0122 348/558
(Continued)

FOREIGN PATENT DOCUMENTS

CN 101159837 A 4/2008
CN 101996591 A 3/2011
(Continued)

OTHER PUBLICATIONS

International Search Report and Written Opinion dated Oct. 17, 2017; PCT/CN2017/092966.
(Continued)

*Primary Examiner* — Adam J Snyder

(57) ABSTRACT

A driving method for a display device, timing controller and display device. The driving method includes: acquiring a target update frequency of image display of a display panel; determining a target frame rate corresponding to the target update frequency according to a prestored corresponding relationship between update frequencies and frame rates; adjusting a blanking duration of a data signal output by a source driving circuit according to the target frame rate; and outputting a first control signal with a frequency being the target frame rate to a gate driving circuit, to cause the gate
(Continued)

driving circuit to scan pixel units of the display panel according to the target frame rate.

18 Claims, 6 Drawing Sheets

(52) U.S. Cl.
CPC . *G09G 2310/08* (2013.01); *G09G 2340/0435* (2013.01); *G09G 2340/0442* (2013.01); *G09G 2340/0464* (2013.01)

(58) Field of Classification Search
USPC ..... 345/55
See application file for complete search history.

(56) References Cited

U.S. PATENT DOCUMENTS

2007/0211801 A1 9/2007 Matsubayashi
2010/0026722 A1* 2/2010 Kondo ..... G09G 3/2007 345/660
2010/0149414 A1 6/2010 Chen et al.
2010/0188574 A1* 7/2010 Hung ..... H04N 7/0105 348/500
2011/0050750 A1 3/2011 Zhao
2011/0153927 A1 6/2011 Sugita
2012/0147020 A1* 6/2012 Hussain ..... G06T 1/00 345/522
2012/0169698 A1* 7/2012 Park ..... G09G 3/20 345/211
2013/0265294 A1* 10/2013 Kim ..... G09G 3/20 345/214
2014/0085275 A1* 3/2014 Tripathi ..... G09G 5/005 345/204
2014/0104255 A1 4/2014 Chen et al.
2016/0035297 A1* 2/2016 Oh ..... G09G 3/3618 345/212
2016/0078838 A1 3/2016 Huang et al.
2016/0078846 A1* 3/2016 Liu ..... G09G 5/18 345/212
2016/0379559 A1* 12/2016 Yamaji ..... G09G 3/2096 345/213
2018/0007311 A1* 1/2018 Kato ..... G09G 5/36

FOREIGN PATENT DOCUMENTS

CN 103403788 A 11/2013
CN 105427785 A 3/2016
CN 105741814 A 7/2016
CN 106205460 A 12/2016

OTHER PUBLICATIONS

The First Chinese Office Action dated Nov. 28, 2017; Appln. No. 201610867454.8.

* cited by examiner

DRIVING METHOD FOR DISPLAY DEVICE, TIMING CONTROLLER AND DISPLAY DEVICE

TECHNICAL FIELD

Embodiments of the present disclosure relate to a driving method for a display device, a timing controller and a display device.

BACKGROUND

A display device generally may include a display panel and a driving circuit for driving the display panel. The driving circuit may comprise a Timing Controller (Tcon), a gate driving circuit and a source driving circuit.

In related technologies, the timing controller may output a first control signal with a fixed frequency to the gate driving circuit, such that the gate driving circuit scans pixel units of the display panel according to the frequency of the first control signal. For example, the frequency of the first control signal is an image refresh rate of the display panel (also called as a frame rate of the display device). Generally, the frame rate of the display device is 60 Hz, i.e., 60 image frames are displayed per second.

In related technologies, the frequency of the first control signal output by the timing controller is generally determined in advance, and thus the display device generally refreshes images displayed on the display panel with a fixed frame rate, and the flexibility of the display device during image display is relatively low.

SUMMARY

In an aspect, embodiments of the disclosure provide a driving method for a display device, comprising:

acquiring a target update frequency of image display of a display panel;

determining a target frame rate corresponding to the target update frequency according to a prestored corresponding relationship between update frequencies and frame rates;

adjusting a blanking duration of a data signal output by a source driving circuit according to the target frame rate; and outputting a first control signal with a frequency being the target frame rate to a gate driving circuit, to cause the gate driving circuit to scan pixel units of the display panel according to the target frame rate.

For example, a display field of the display panel includes an active field and a blanking field located around the active field; and adjusting the blanking duration of the data signal output by the source driving circuit according to the target frame rate includes:

acquiring a preset pixel refresh rate Fc;

calculating an area of the blanking field according to the target frame rate, an area of the active field, the preset pixel refresh rate Fe, and a pixel refresh rate formula, with the pixel refresh rate formula being:

$$Fc=(A1+A2)\times Fr,$$

where Fr is the target frame rate, A1 is the area of the active field, and A2 is the area of the blanking field; and adjusting a frequency of a second control signal output to the source driving circuit according to the calculated area of the blanking field, to cause the source driving circuit to adjust the blanking duration of the data signal according to the frequency of the second control signal.

For example, adjusting the frequency of the second control signal output to the source driving circuit according to the calculated area of the blanking field includes:

adjusting at least one of a height and a width of the blanking field according to the calculated area of the blanking field, so as to adjust the frequency of the second control signal.

For example, acquiring the target update frequency of the image display of the display panel includes:

acquiring the target update frequency of the image display of the display panel in every preset time period.

For example, acquiring the target update frequency of the image display of the display panel includes:

calculating change times of the image display of the display panel in the preset time period; and determining the target update frequency F according to a length T of the preset time period and the change times N, wherein F=N/T.

For example, in the prestored corresponding relationship between update frequencies and frame rates, a frame rate is positively correlated with an update frequency.

In a second aspect, embodiments of the disclosure provide a timing controller, comprising:

an acquiring module, configured to acquire a target update frequency of image display of a display panel;

a determining module, configured to determine a target frame rate corresponding to the target update frequency according to a prestored corresponding relationship between update frequencies and frame rates;

an adjusting module, configured to adjust a blanking duration of a data signal output by a source driving circuit according to the target frame rate; and an output module, configured to output a first control signal with a frequency being the target frame rate to a gate driving circuit, to cause the gate driving circuit to scan pixel units of the display panel according to the target frame rate.

For example, a display field of the display panel includes an active field and a blanking field located around the active field; and the adjusting module includes:

an adjusting submodule, configured to acquire a preset pixel refresh rate Fc;

a calculating submodule, configured to calculate an area of the blanking field according to the target frame rate, an area of the active field, the preset pixel refresh rate Fc, and a pixel refresh rate formula, with the pixel refresh rate formula being:

$$Fc=(A1+A2)\times Fr,$$

where Fr is the target frame rate, A1 is the area of the active field, and A2 is the area of the blanking field; and an adjusting submodule, configured to adjust a frequency of a second control signal output to the source driving circuit according to the calculated area of the blanking field, to cause the source driving circuit to adjust the blanking duration of the data signal according to the frequency of the second control signal.

For example, the adjusting submodule is further configured to:

adjust a height and a width of the blanking field according to the calculated area of the blanking field, so as to adjust the frequency of the second control signal.

For example, the acquiring module is further configured to:

acquire the target update frequency of the image display of the display panel in every preset time period.

For example, the acquiring module is further configured to:

calculate change times N of the image display of the display panel in the preset time period; and determine the target update frequency F according to a length T of the preset time period and the change times N, wherein F=N/T.

For example, in the prestored corresponding relationship between update frequencies and frame rates, a frame rate is positively correlated with an update frequency.

In a third aspect, embodiments of the disclosure provide a display device, comprising: the timing controller in the second aspect described above.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

DETAILED DESCRIPTION

In order to illustrate the purposes, the technical solutions and the advantages in the present disclosure more clearly, the embodiments of the present disclosure will be described in a clearly and fully understandable way in connection with the drawings. It is obvious that the described embodiments are just a part but not all of the embodiments of the present disclosure. Based on embodiments of the present disclosure, all other embodiments obtained by those skilled in the art without making other inventive work should be within the scope of the present disclosure.

Figure 1:
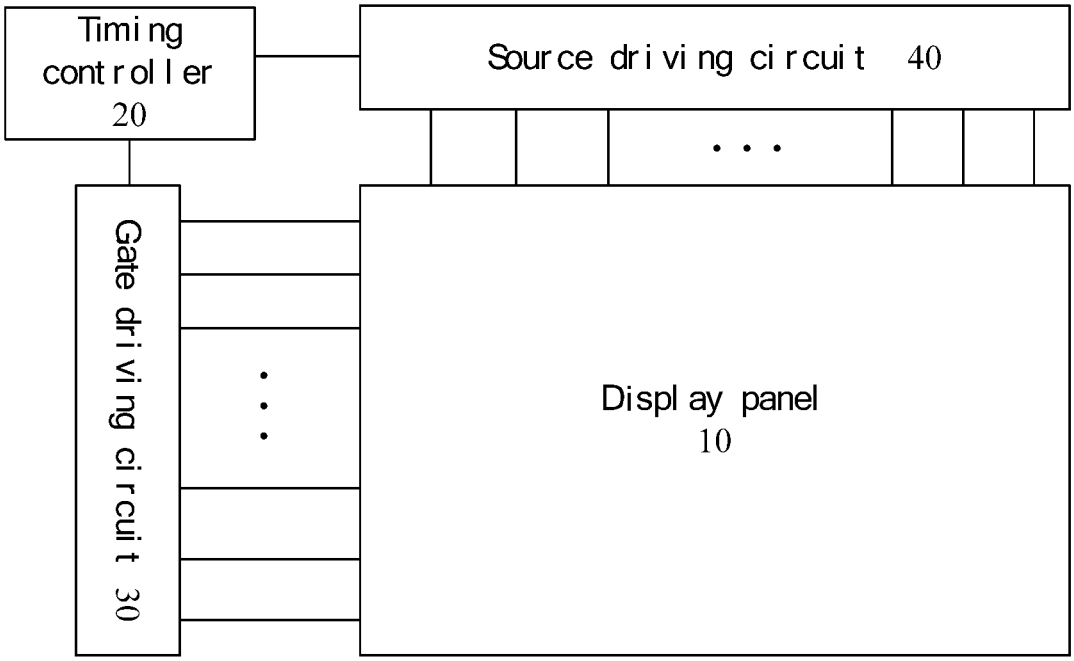
FIG. 1 is a structural schematic diagram of a display device provided by an embodiment of the present disclosure.

FIG. 1 is a structural schematic diagram of a display device provided by an embodiment of the present disclosure. As shown in FIG. 1, the display device may include a display panel 10, a timing controller 20, a gate driving circuit 30 and a source driving circuit 40. For example, the gate driving circuit 30 is used for scanning respective rows of pixel units in the display panel 10 row by row, the source driving circuit 40 is used for providing data signals for respective columns of pixel units in the display panel 10, and the timing controller 20 is connected to the gate driving circuit 30 and the source driving circuit 40 respectively, and used for controlling signals output from the gate driving circuit 30 and the source driving circuit 40.

Specifically, the timing controller 20 may output a first control signal with a certain frequency to the gate driving circuit 30, such that the gate driving circuit 30 may scan the pixel units of the display panel 10 according to the frequency of the first control signal. The timing controller 20 may also output a second control signal to the source driving circuit 40, such that the source driving circuit 40 may output the data signals according to a frequency of the second control signal.

Figure 2:
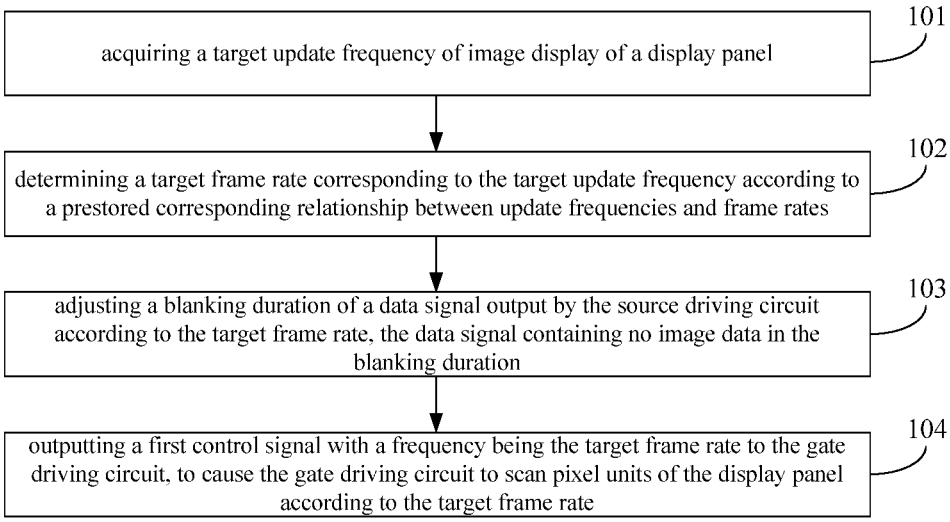
FIG. 2 is a flowchart of a driving method for a display device provided by an embodiment of the present disclosure.

FIG. 2 is a flowchart of a driving method for a display device provided by an embodiment of the present disclosure, and the method may be applied to the timing controller 20 as shown in FIG. 1. Referring to FIG. 2, the driving method may comprise:

Step 101: acquiring a target update frequency of image display of a display panel;

Step 102: determining a target frame rate corresponding to the target update frequency according to a prestored corresponding relationship between update frequencies and frame rates;

Step 103: adjusting a blanking duration of a data signal output by the source driving circuit according to the target frame rate, the data signal containing no image data in the blanking duration;

Step 104: outputting a first control signal with a frequency being the target frame rate to the gate driving circuit, to cause the gate driving circuit to scan pixel units of the display panel according to the target frame rate.

Thus, an embodiment of the present disclosure provides a driving method for a display device; in the driving method, the timing controller can determine the target frame rate according to the target update frequency for displaying images in the display panel and output the first control signal with a frequency being the target frame rate to the gate driving circuit, and can also adjust the blanking duration of the data signal output by the source driving circuit according to the target frame rate. Compared with a fixed frame rate in related technologies, the target frame rate and the blanking duration of the data signal in the driving method provided by the embodiments of the present disclosure are adjusted in real time according to the update frequency for displaying images, and the flexibility of the driving method is higher.

Figure 3A:
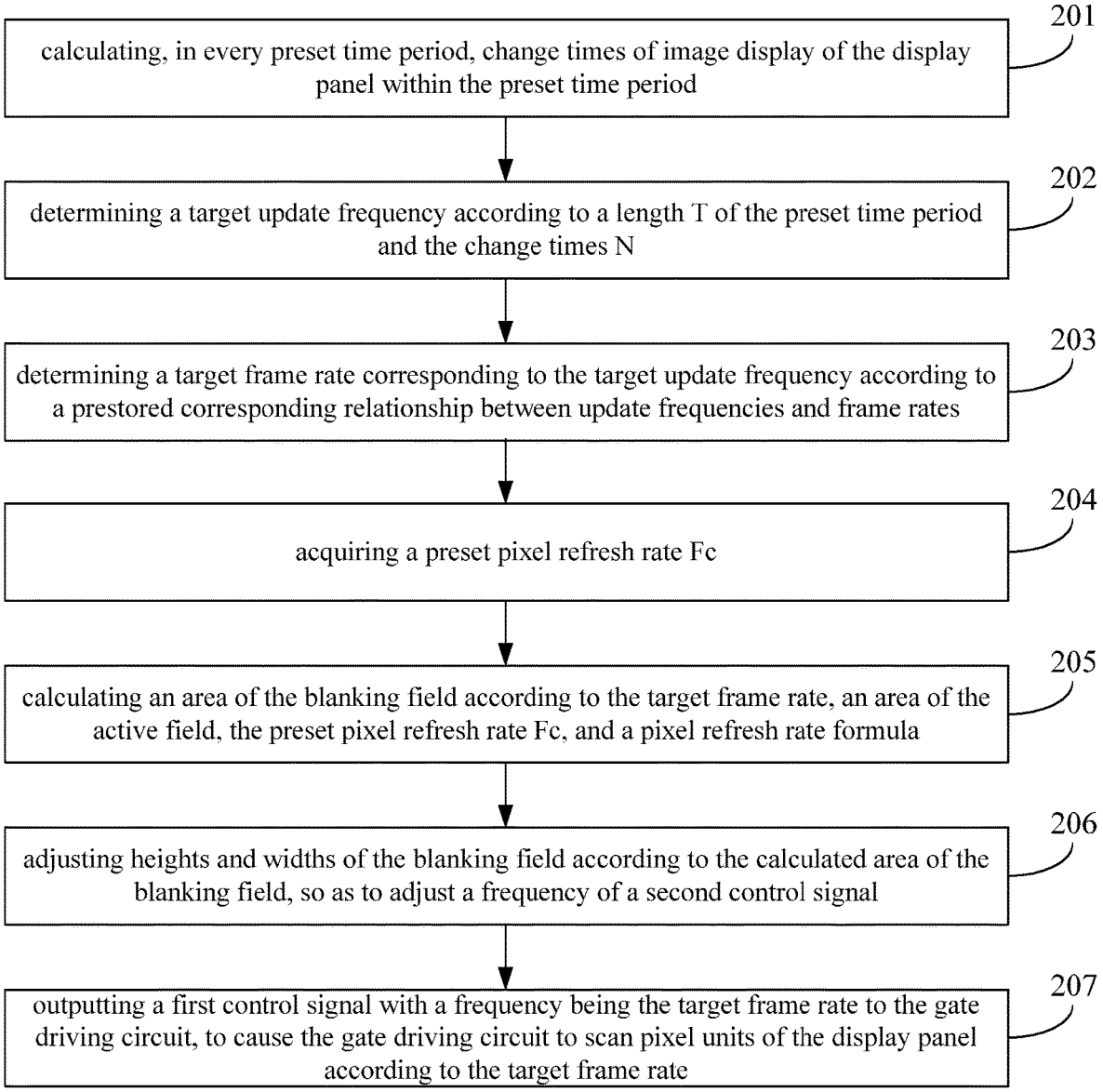
FIG. 3A is another flowchart of a driving method for a display device provided by an embodiment of the present disclosure.

FIG. 3A is another flowchart of a driving method for a display device provided by an embodiment of the present disclosure, the method may be applied to the timing controller 20 as shown in FIG. 1, and the timing controller is connected to the gate driving circuit and the source driving circuit respectively. Referring to FIG. 3A, the driving method may comprise:

Step 201: calculating, in every preset time period, change times of image display of the display panel within the preset time period.

In embodiments of the present disclosure, in order to adjust the frame rate of the display device and the blanking duration of the data signal in real time according to a change condition of image display of the display panel, the timing controller may acquire the target update frequency of the current image display of the display panel in every preset time period. The target update frequency refers to a change frequency of the image display of the display panel, and therefore the timing controller can determine the target update frequency according to the change times of the image display in the preset time period. For example, a change amount threshold may be preset in the display device; when a change amount between two adjacent displayed image frames is greater than the change amount threshold, then it can be determined that the image display is changed; if the change amount between the two adjacent displayed image frames is not greater than the change amount threshold, then it can be determined that the image display is unchanged. For example, assuming that the preset time period is 1 second (s), then the timing controller may acquire the change times of the image display within the 1-second period to be, for example, 13 times.

It should be noted that in actual application, the change times of the image display of the display panel in the preset time period may be actively acquired by the timing controller, or may be sent to the timing controller by the display panel, which is not limited by embodiments of the present disclosure.

Step 202: determining a target update frequency according to a length T of the preset time period and the change times N.

For example, the target update frequency F may be F=N/T. For example, assuming that the preset time period is 1 s, and the change times acquired by the timing controller are 13 times, then the timing controller can determine that the target update frequency F of the image display of the display device is 13 times/s.

Step 203: determining a target frame rate corresponding to the target update frequency according to a prestored corresponding relationship between update frequencies and frame rates.

In embodiments of the present disclosure, the timing controller may pre-store the corresponding relationship between update frequencies and frame rates, and in the corresponding relationship, a frame rate is positively correlated with an update frequency. That is, when an update frequency of the image display is higher (i.e., the change of the displayed images is faster, for example, a game scene), a corresponding frame rate is also higher, that is, a refresh rate of the display device for displaying images is also higher, to ensure a display effect. When the update frequency of the image display is lower (i.e., the displayed images tend to be static, for example, a reading scene), the corresponding frame rate is also lower, that is, the refresh rate of the display device for displaying images is also lower, to reduce power consumption. When the update frequency of the image display is lower or the displayed image is static, the reduction of the frame rate will not cause an influence on a display effect of the display image, and therefore unnecessary power consumption waste can be avoided and a standby time of the display device can be prolonged by properly reducing the frame rate.

For example, the prestored corresponding relationship between update frequencies and frame rates in the timing controller may be as shown in table 1, where: when the update frequency of the image display is 0-5 times/s, the corresponding frame rate is 30 Hz; when the update frequency is greater than 5 times/s and less than 10 times/s, the corresponding frame rate is 40 Hz; when the update frequency is greater than 10 times/s and less than 15 times/s, the corresponding frame rate is 48 Hz; and when the update frequency is greater than 15 times/s, the corresponding frame rate is 60 Hz. If the target update frequency of the current image display of the display panel that the timing controller acquires is 13 times/s, then according to the corresponding relationship as shown in table 1, the timing controller can determine that the target frame rate corresponding to the target update frequency 13 times/s is 48 Hz.

TABLE 1

| Update frequency (times/s) | Frame rate |
|---|---|
| [0, 5] | 30 Hz |
| (5, 10] | 40 Hz |
| (10, 15] | 48 Hz |
| >15 | 60 Hz |

Step 204: acquiring a preset pixel refresh rate Fc.

The pixel refresh rate is also called as a pixel clock, and refers to a refresh frequency of each pixel in the display device. In embodiments of the present disclosure, the pixel refresh rate Fc is preset before design and manufacture of the display device, that is, the pixel refresh rate Fc of the display device is a preset fixed value. For example, the pixel refresh rate Fc may be 39.79 MHz.

Step 205: calculating an area of the blanking field according to the target frame rate, an area of the active field, the preset pixel refresh rate Fc, and a pixel refresh rate formula.

In embodiments of the present disclosure, the pixel refresh rate formula is Fc=(A1+A2)×Fr; where Fr is the target frame rate, A1 is the area of the active field, and A2 is the area of the blanking field.

Figure 3B:
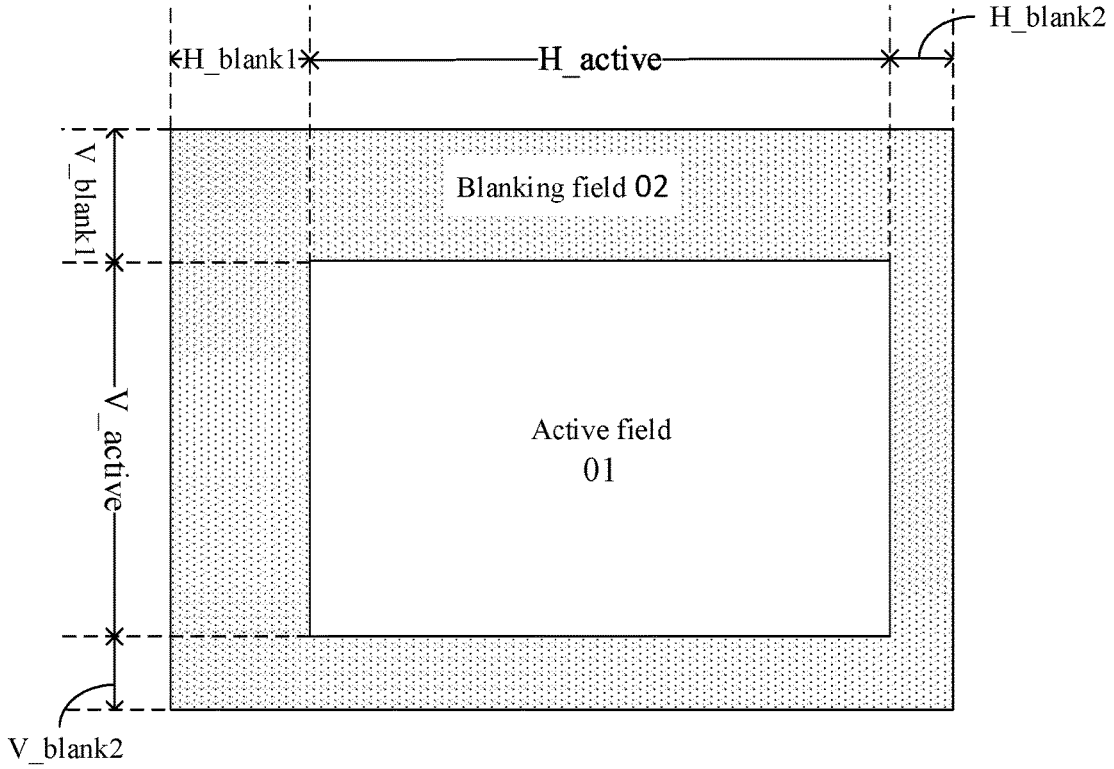
FIG. 3B is a schematic diagram of a display field of a display panel provided by an embodiment of the present disclosure.

In embodiments of the present disclosure, referring to FIG. 3B, a display field of the display panel may include an active field 01 and a blanking field 02 located around the active field. For example, the active field 01 is a data effective field, that is, a field for actually displaying images, and the size of the active field 01 is fixed; while the blanking field 02 is a field not displaying images, and is a field for making preparation for data cache, and the size of the blanking field 02 is adjustable generally.

From FIG. 3B, it can be seen that an area A (i.e., A1−A2) of a display field of the display device may be represented as:

$$A=(H_active+H_blank1+H_blank2)\times(V_active+V_blank1+V_blank2);$$

where H_active and V_active are respectively a width value of the active field 01 in a horizontal direction (i.e., a gate line scan direction) and a height value of the active field 01 in a vertical direction (i.e., a data line scan direction); H_blank1 and H_blank2 are width values of the blanking field 02 on left and right sides of the active field 01 in the horizontal direction respectively; and V_blank1 and V_blank2 are two height values of the blanking field 02 on upper and lower sides of the active field 01 in the vertical direction respectively. The above height values may refer to the number of rows of pixels or the number of rows of gate lines, and the width values may be the number of columns of pixels or a number of columns of data lines.

For example, assuming that for a display panel with a resolution 1056×628, the display field may be divided as table 2, where the width value H_active of the active field may be 800 columns of pixels, the height value V_active is 600 rows of pixels, that is, an effective display resolution of the display panel is 800×600; the width value H_blank1 of the blanking field is 216 columns of pixels, the width value H_blank2 is 40 columns of pixels, the height value V-blank1 is 27 rows of pixels and the height value V_blank2 is 1 row of pixels.

TABLE 2

| H_blank1 | H_active | H_blank2 | Total column pixels |
|---|---|---|---|
| 216 | 800 | 40 | 1056 |
| V_blank1 | V_active | V_blank2 | Total row pixels |
| 27 | 600 | 1 | 628 |

Further, according to the above pixel refresh rate formula Fc=(A1+A2)×Fr, it can be known that since the target frame rate Fr is 48 Hz, the area A1 of the active field is 800×600, and the pixel refresh rate Fc is 39.79 MHz, then the area A2 of the blanking field may be calculated to be 348960.

Step 206: adjusting heights and widths of the blanking field according to the calculated area of the blanking field, so as to adjust a frequency of a second control signal.

In embodiments of the present disclosure, after the timing controller determines the area of the blanking field according to the target frame rate, the area of the active field, the preset pixel refresh rate Fc and the pixel refresh rate formula, it can be known by referring to FIG. 3B that: since the blanking field 02 is a regular rectangular annular field, the timing controller may achieve an effect of adjusting the area of the blanking field 02 by adjusting the widths H_blank1 and H_blank2 of the blanking field 02 and/or the heights V_blank1 and V_blank2 of the blanking field 02. For example, the timing controller may keep the heights V_blank1 and V_blank2 of the blanking field 02 unchanged and only adjust the widths H_blank1 and H_blank2 of the blanking field 02; or the timing controller may also simultaneously adjust the heights V_blank1 and V_blank2 of the blanking field 02 as well as the widths H_blank1 and H_blank2 of the blanking field 02, to cause the area of the adjusted blanking field 02 to be equal to the calculated area of the blanking field.

For example, assuming that the area A2 of the blanking field determined by the timing controller according to the pixel refresh rate formula is 348960, then the timing controller may keep the heights V_blank1 and V_blank2 of the blanking field 02 unchanged and only adjust the widths H_blank1 and H_blank2 of the blanking field, so that a sum of the adjusted widths H_blank1 and H_blank2 is equal to 520 columns of pixels, and at this point, the area A2 of the blanking field 02 equals to (520+800)×628−800×600=348960; or, the timing controller may keep the widths H_blank1 and H_blank2 of the blanking field 02 unchanged and only adjust the heights V_blank1 and V_blank2 of the blanking field 02, so that a sum of the adjusted heights V_blank1 and V_blank2 is equal to 185 rows of pixels, and at this point, the area A2 of the blanking field 02 equals to 1056×(185+600)−800×600=348960.

Figure 3C:
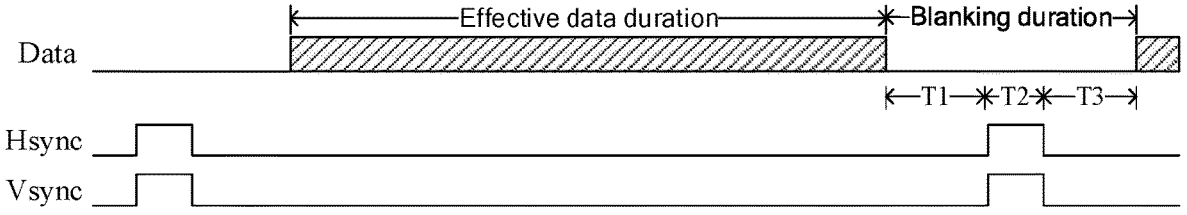
FIG. 3C is a schematic diagram of a data signal provided by an embodiment of the present disclosure.

After the timing controller adjusts the lengths and/or widths of the blanking field, the frequency of the second control signal output from the timing controller to the source driving circuit is also changed, and the source driving circuit may adjust the blanking duration of an output data signal according to the frequency of the second control signal. FIG. 3C is a schematic diagram of a data signal Data provided by an embodiment of the present disclosure. It can be known by referring to FIG. 3C that each period of the data signal Data output by the source driving circuit may include an effective data duration and a blanking duration. For example, the data signal in the effective data duration contains an effective data signal, i.e., image data for displaying an image; in the blanking duration, the data signal contains no image data. Specifically, as shown in FIG. 3C, the blanking duration may specifically include a synchronous front porch T1, a synchronous time duration (Sync) T2 and a synchronous back porch T3. In addition, a signal Hsync in FIG. 3C is a line synchronous signal, and a signal Vsync is a frame synchronous signal.

In an actual application, the timing controller may store all of the various parameters including sizes of the blanking field in a memory (for example, EEPROM), and the timing controller may change the heights and widths of the blanking field by writing data into the memory on line, so as to adjust the frequency of the second control signal. After the frequency of the second control signal is changed, the blanking duration of the data signal output by the source driving circuit is also changed correspondingly, and the blanking duration is positively correlated with the area of the blanking field, that is, the larger the blanking field is, the longer the blanking duration of the data signal is.

Step 207: outputting a first control signal with a frequency being the target frame rate to the gate driving circuit, to cause the gate driving circuit to scan pixel units of the display panel according to the target frame rate.

In embodiments of the present disclosure, after the timing controller determines the target frame rate, besides that the area of the blanking field may be adjusted according to the target frame rate, the frequency of the first control signal output to the gate driving circuit may also be adjusted according to the target frame rate, such that the frequency of the first control signal is equal to the target frame rate, and then, the gate driving circuit may scan the pixel units of the display panel according to the target frame rate, that is, the display device is caused to refresh the image display according to the target frame rate.

Figure 3D:
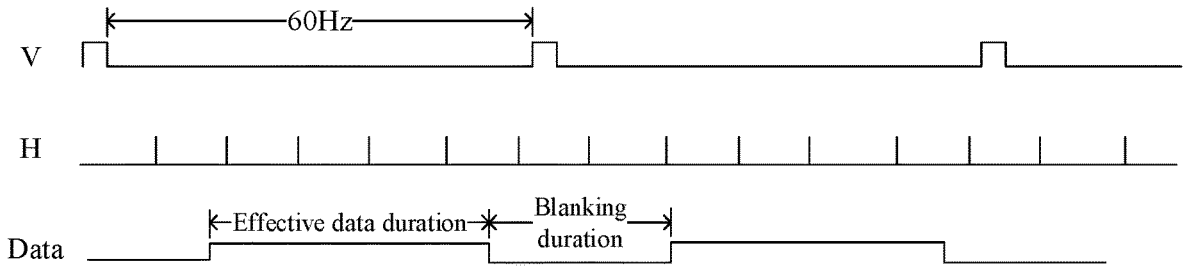
FIG. 3D is a schematic diagram of respective signals in a display device provided by an embodiment of the present disclosure.
Figure 3E:
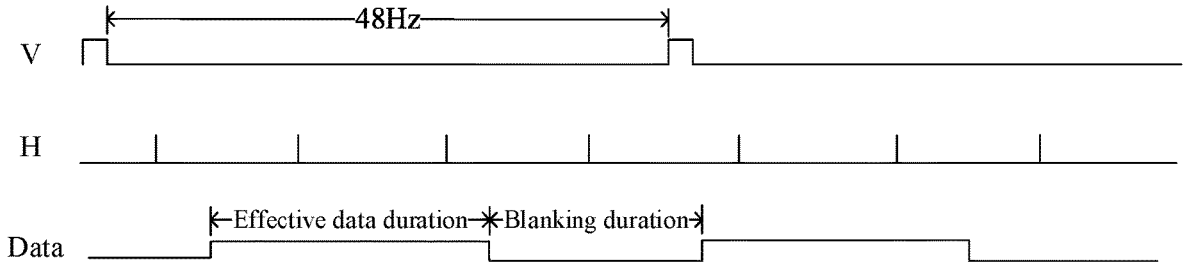
FIG. 3E is another schematic diagram of respective signals in a display device provided by an embodiment of the present disclosure.

FIG. 3D is a schematic diagram of respective signals in a display device when the target update frequency of the image display is a first frequency provided by an embodiment of the present disclosure; and FIG. 3E is a schematic diagram of respective signals in a display device when the target update frequency of the image display is a second frequency provided by an embodiment of the present disclosure. The first frequency is higher than the second frequency. The signal V in FIGS. 3D and 3E is the first control signal output by the timing controller to the gate driving circuit, the signal H is the second control signal output by the timing controller to the source driving circuit, and the signal Data is the data signal output by the source driving circuit. By comparing FIGS. 3D and 3E, it can be known that when the target update frequency of the image display is higher, the frequencies of the first control signal V and the second control signal H output by the timing controller are also higher, and the blanking duration of the data signal Data output by the source driving circuit is shorter. As shown in FIG. 3D, the frequency of the first control signal V may be 60 Hz, and at this point, the refresh rate of the displayed images by the display device is higher, and a better display effect can be ensured. When the target update frequency of the image display is lower, the frequencies of the first control signal V and the second control signal H output by the timing controller are also lower, and the blanking duration of the data signal Data is longer. For example, as shown in FIG.

3E, the frequency of the first control signal V may be 48 Hz, and at this point, the refresh rate of the displayed images by the display device is lower, and power consumption of the display device is lower; but the change of the image display at this point is smaller, and therefore, a lower frame rate will not have influence on the display effect of the displayed images.

Figure 3F:
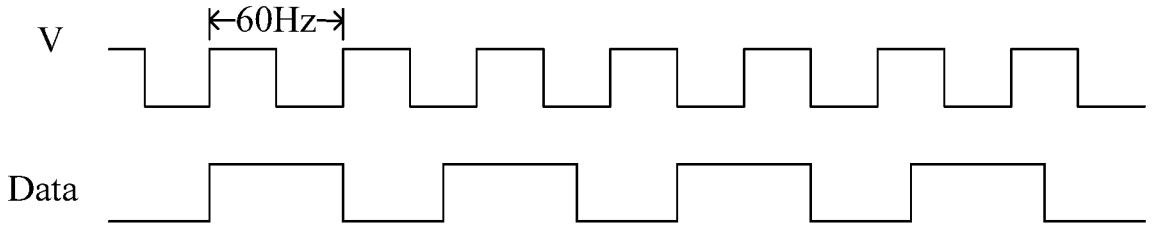
FIG. 3F is a simulation timing diagram of respective signals in a display device provided by an embodiment of the present disclosure.
Figure 3G:
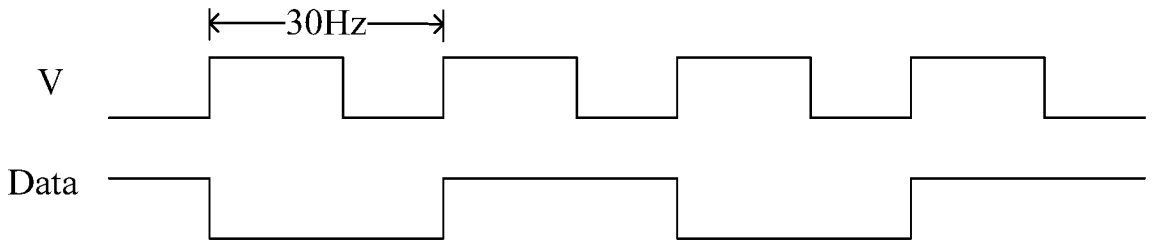
FIG. 3G is another simulation timing diagram of respective signals in a display device provided by an embodiment of the present disclosure.

FIG. 3F is a simulation timing diagram of respective signals in a display device when the target update frequency of the image display is a first frequency provided by an embodiment of the present disclosure, and FIG. 3G is a simulation timing diagram of respective signals in a display device when the target update frequency of the image display is a second frequency provided by an embodiment of the present disclosure. For example, assuming that the first frequency is 20 times/s, and then according to the corresponding relationship as shown in table 1, it can be known that the target frame rate should be 60 Hz. That is, as shown in FIG. 3F, the frequency of the first control signal V output by the timing controller is 60 Hz. Assuming that the second frequency is 2 times/s, and then according to the corresponding relationship as shown in table 1, it can be known that the target frame rate should be 30 Hz. That is, as shown in FIG. 3G, the frequency of the first control signal V is 30 Hz. By comparing FIGS. 3F and 3G, it can also be seen that when the target update frequency of the image display is higher, a signal frequency of the data signal Data is also higher (the blanking duration of the data signal is not shown in FIGS. 3F and 3G). That is, the driving method provided by the present disclosure can match a frequency of a driving signal output from a back end of the display device with the update frequency of the image display of a front end, and the power consumption of the display device is further reduced under a premise of ensuring the display effect.

It should be noted that a sequence of the steps of the driving method for a display device provided by embodiments of the present disclosure may be properly adjusted, and the number of steps may also be correspondingly increased and reduced according to actual scenarios. Changes of the method in a technical scope disclosed in the present disclosure conceived by any one skilled in the art should be covered in a protective scope of the present disclosure, and thus repeated description is omitted here.

From above, embodiments of the present disclosure provide a driving method for a display device. In the driving method, the timing controller can determine the target frame rate according to the target update frequency of image display of the display panel and output the first control signal with a frequency being a target frame rate to the gate driving circuit, and can also adjust the blanking duration of the data signal output by the source driving circuit according to the target frame rate. Compared with a fixed frame rate in related technologies, the target frame rate and the blanking duration of the data signal in the driving method provided by embodiments of the present disclosure are adjusted in real time according to the update frequency of the image display, and the flexibility of the driving method is higher; besides, when the update frequency of the image display is lower, the frame rate of the display device is also lower, thereby effectively reducing the power consumption of the display device while ensuring that the display effect of the displayed images is not affected.

Figure 4A:
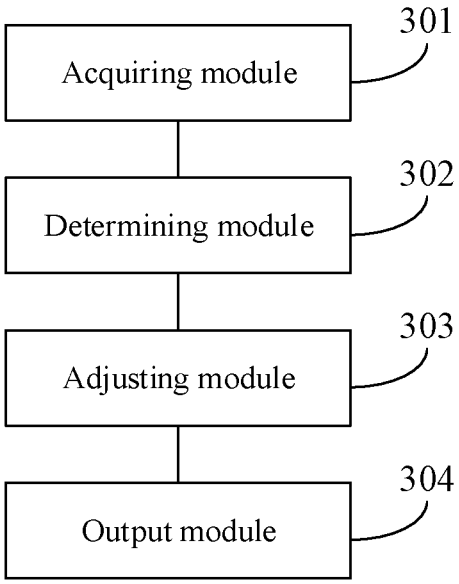
FIG. 4A is a structural schematic diagram of a timing controller provided by an embodiment of the present disclosure.

Referring to FIG. 4A, an embodiment of the present disclosure provides a timing controller. The timing controller may be connected to a gate driving circuit and a source driving circuit respectively, and the timing controller may comprise:

an acquiring module 301, configured to acquire a target update frequency of image display of a display panel;

a determining module 302, configured to determine a target frame rate corresponding to the target update frequency according to a prestored corresponding relationship between update frequencies and frame rates;

an adjusting module 303, configured to adjust a blanking duration of a data signal output by the source driving circuit according to the target frame rate, in the blanking duration the data signal containing no image data; and an output module 304, configured to output a first control signal with a frequency being the target frame rate to the gate driving circuit, to cause the gate driving circuit to scan pixel units of the display panel according to the target frame rate.

From above, embodiments of the present disclosure provide a timing controller. The timing controller can determine the target frame rate according to the target update frequency of current image display of the display panel and output the first control signal with a frequency being the target frame frequency to the gate driving circuit, and can also adjust the blanking duration of the data signal output by the source driving circuit according to the target frame rate. Compared with a fixed frame rate in related technologies, the target frame rate and the blanking duration of the data signal in the timing controller provided by embodiments of the present disclosure are adjusted according to the update frequency of the image display in real time, and the flexibility of the timing controller is higher.

Figure 4B:
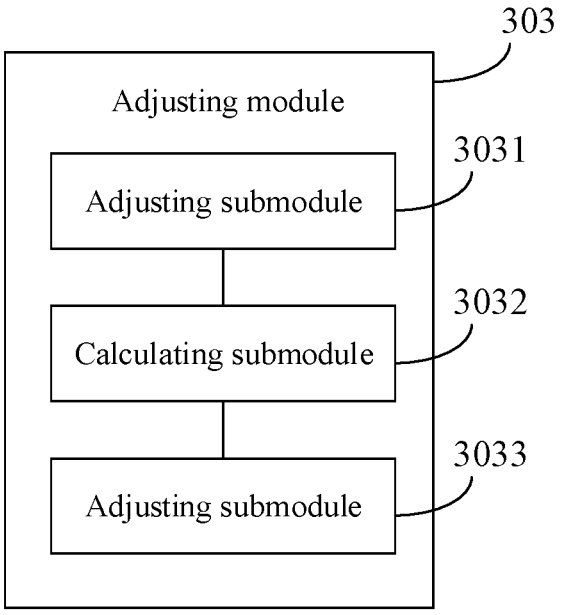
FIG. 4B is a structural schematic diagram of an adjusting module provided by an embodiment of the present disclosure.

For example, a display field of the display panel includes: an active field and a blanking field located around the active field; and as shown in FIG. 4B, the adjusting module 303 may include:

an adjusting submodule 3031, configured to acquire a preset pixel refresh rate Fc;

a calculating submodule 3032, configured to calculate an area of the blanking field according to the target frame rate, an area of the active field, the preset pixel refresh rate Fc, and a pixel refresh rate formula, with the pixel refresh rate formula being:

$$Fc=(A1+A2)\times Fr,$$

where Fr is the target frame rate, A1 is the area of the active field, and A2 is the area of the blanking field; and an adjusting submodule 3033, configured to adjust a frequency of a second control signal output to the source driving circuit according to the calculated area of the blanking field, to cause the source driving circuit to adjust the blanking duration of the data signal according to the frequency of the second control signal.

For example, the adjusting submodule 3033 is further configured to adjust heights and widths of the blanking fields according to the calculated area of the blanking field, so as to adjust the frequency of the second control signal.

For example, the acquiring module 301 is further configured to:

acquire a target update frequency of the current image display of the display panel in every preset time period.

Further, the acquiring module 301 is further configured to:

calculate change times N of the image display of the display panel in the preset time period; and determine the target update frequency F according to a length T of the preset time period and the change times N, wherein F=N/T.

For example, in the prestored corresponding relationship between update frequencies and frame rates, the frame rate is positively correlated with the update frequency.

From above, embodiments of the present disclosure provide a timing controller. The timing controller can determine the target frame rate according to the target update frequency of current image display of the display panel and output the first control signal with a frequency being the target frequency to the gate driving circuit, and can also adjust the blanking duration of the data signal output by the source driving circuit according to the target frame rate. Compared with a fixed frame rate in related technologies, the target frame rate and the blanking duration of the data signal in the timing controller provided by embodiments of the present disclosure are adjusted according to the update frequency of the image display in real time, and the flexibility of the timing controller is higher.

For convenience and compactness of description, specific working processes of the timing controller and respective modules described above may refer to the corresponding processes in the foregoing method embodiments, which is not repeated here.

Of course, generally, the timing controller provided by embodiments of the present disclosure may also include: a phase-locked loop PLL, an Inter-Integrated Circuit (I2C) interface, a frequency divider, a horizontal synchronous block, a vertical synchronous block and a control signal block, etc., which are not repeated by the present disclosure here.

The timing controller according to embodiments of the present disclosure may further include one or more processors and one or more memories. The processor may process data signals and may include various computing architectures such as a complex instruction set computer (CISC) architecture, a reduced instruction set computer (RISC) architecture or an architecture for implementing a combination of multiple instruction sets. The memory may store instructions and/or data executed by the processor. The instructions and/or data may include codes which are configured to achieve some functions or all the functions of one or more devices in the embodiments of the present disclosure. For instance, the memory includes a dynamic random access memory (DRAM), a static random access memory (SRAM), a flash memory, an optical memory or other memories well known to those skilled in the art.

In some embodiments of the present disclosure, the acquiring module, the determining module, the adjusting module (including the acquiring submodule, the calculating submodule and the adjusting submodule) and/or the output module include codes and programs stored in the memory; and the processor may execute the codes and programs to achieve some or all functions as mentioned above.

In some embodiments of the present disclosure, the acquiring module, the determining module, the adjusting module (including the acquiring submodule, the calculating submodule and the adjusting submodule) and/or the output module may be specialized hardware devices and are used for implementing some or all functions as mentioned above. For example, the acquiring module, the determining module, the adjusting module (including the acquiring submodule, the calculating submodule and the adjusting submodule) and/or the output module may be a circuit board or a combination of multiple circuit boards and are used for implementing the functions as mentioned above. In the embodiments of the present disclosure, the circuit board or combination of multiple circuit boards may include: (1) one or more processors; (2) one or more non-transitory computer readable memories connected to the processor; and (3) firmware executable by the processor and stored in the memory. For another example, the acquiring module, the determining module, the adjusting module (including the acquiring submodule, the calculating submodule and the adjusting submodule) and/or the output module may be implemented by using an Application Specific Integrated Circuit (ASIC), a Field Programmable Gate Array (FPGA) or other programmable logic devices.

An embodiment of the present disclosure further provides a display device, and the display device may comprise the timing controller as shown in FIG. 4A. The display device may be: any product or part having a display function, such as a liquid crystal panel, electronic paper, an OLED panel, an AMOLED panel, a mobile phone, a tablet computer, a television, a display, a laptop, a digital photo frame, a navigator and the like.

The foregoing is merely exemplary embodiments of the present disclosure, and not intended to confine the present disclosure, and any modifications, equivalent substitutions, improvements, etc., made within a spirit and principle of the present disclosure should be covered in a protective scope of the present disclosure.

In the present disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The present application claims the priority of the Chinese Patent Application No. 201610867454.8 filed on Sep. 29, 2016, which is incorporated herein by reference in its entirety as part of the disclosure of the present application.

The invention claimed is:

1. A driving method for a display device, comprising:

acquiring a target update frequency of image display of a display panel;

determining a target frame rate corresponding to the target update frequency according to a prestored corresponding relationship between update frequencies and frame rates;

adjusting a blanking duration of a data signal output by a source driving circuit according to the target frame rate; and outputting a first control signal with a frequency being the target frame rate to a gate driving circuit, to cause the gate driving circuit to scan pixel units of the display panel according to the target frame rate, wherein a display field of the display panel includes an active field and a blanking field located around the active field; and adjusting the blanking duration of the data signal output by the source driving circuit according to the target frame rate includes:

acquiring a preset pixel refresh rate Fc;

calculating an area of the blanking field according to the target frame rate, an area of the active field, the preset pixel refresh rate Fc, and a pixel refresh rate formula, with the pixel refresh rate formula being:

$$Fc=(A1+A2)\times Fr,$$

where Fr is the target frame rate, A1 is the area of the active field, and A2 is the area of the blanking field; and adjusting a frequency of a second control signal output to the source driving circuit according to the calculated area of the blanking field, to cause the source driving circuit to adjust the blanking duration of the data signal according to the frequency of the second control signal.

2. The method according to claim 1, wherein adjusting the frequency of the second control signal output to the source driving circuit according to the calculated area of the blanking field includes:

adjusting at least one of a height and a width of the blanking field according to the calculated area of the blanking field, so as to adjust the frequency of the second control signal.

3. The method according to claim 2, wherein acquiring the target update frequency of the image display of the display panel includes:

acquiring the target update frequency of the image display of the display panel in every preset time period.

4. The method according to claim 2, wherein in the prestored corresponding relationship between update frequencies and frame rates, a frame rate is positively correlated with an update frequency.

5. The method according to claim 1, wherein acquiring the target update frequency of the image display of the display panel includes:

acquiring the target update frequency of the image display of the display panel in every preset time period.

6. The method according to claim 5, wherein acquiring the target update frequency of the image display of the display panel includes:

calculating change times of the image display of the display panel in the preset time period; and determining the target update frequency F according to a length T of the preset time period and the change times N, wherein F=N/T.

7. The method according to claim 1, wherein in the prestored corresponding relationship between update frequencies and frame rates, a frame rate is positively correlated with an update frequency.

8. The method according to claim 1, wherein acquiring the target update frequency of the image display of the display panel includes:

acquiring the target update frequency of the image display of the display panel in every preset time period.

9. The method according to claim 1, wherein in the prestored corresponding relationship between update frequencies and frame rates, a frame rate is positively correlated with an update frequency.

10. A timing controller, comprising:

an acquiring module, configured to acquire a target update frequency of image display of a display panel;

a determining module, configured to determine a target frame rate corresponding to the target update frequency according to a prestored corresponding relationship between update frequencies and frame rates;

an adjusting module, configured to adjust a blanking duration of a data signal output by a source driving circuit according to the target frame rate; and an output module, configured to output a first control signal with a frequency being the target frame rate to a gate driving circuit, to cause the gate driving circuit to scan pixel units of the display panel according to the target frame rate;

wherein a display field of the display panel includes an active field and a blanking field located around the active field; and the adjusting module includes:

an adjusting submodule, configured to acquire a preset pixel refresh rate Fc;

a calculating submodule, configured to calculate an area of the blanking field according to the target frame rate, an area of the active field, the preset pixel refresh rate Fc, and a pixel refresh rate formula, with the pixel refresh rate formula being:

$$Fc=(A1+A2)\times Fr,$$

where Fr is the target frame rate, A1 is the area of the active field, and A2 is the area of the blanking field; and an adjusting submodule, configured to adjust a frequency of a second control signal output to the source driving circuit according to the calculated area of the blanking field, to cause the source driving circuit to adjust the blanking duration of the data signal according to the frequency of the second control signal.

11. The timing controller according to claim 10, wherein the adjusting submodule is further configured to:

adjust a height and a width of the blanking field according to the calculated area of the blanking field, so as to adjust the frequency of the second control signal.

12. The timing controller according to claim 11, wherein the acquiring module is further configured to:

acquire the target update frequency of the image display of the display panel in every preset time period.

13. The timing controller according to claim 10, wherein the acquiring module is further configured to:

acquire the target update frequency of the image display of the display panel in every preset time period.

14. The timing controller according to claim 13, wherein the acquiring module is further configured to:

calculate change times N of the image display of the display panel in the preset time period; and determine the target update frequency F according to a length T of the preset time period and the change times N, wherein F=N/T.

15. The timing controller according to claim 10, wherein in the prestored corresponding relationship between update frequencies and frame rates, a frame rate is positively correlated with an update frequency.

16. A display device, comprising:

the timing controller according to claim 10.

17. The timing controller according to claim 10, wherein the acquiring module is further configured to:

acquire the target update frequency of the image display of the display panel in every preset time period.

18. The timing controller according to claim 10, wherein in the prestored corresponding relationship between update frequencies and frame rates, a frame rate is positively correlated with an update frequency.

* * * * *